United States Patent [19]

Schaefer

[11] 4,353,657

[45] Oct. 12, 1982

[54] RIBBON FEED MECHANISM AND CORRECTION TAPE FEED MECHANISM FOR A TYPEWRITER

[75] Inventor: John O. Schaefer, Lexington, Ky.

[73] Assignee: International Business Machines Corporation, Armonk, N.Y.

[21] Appl. No.: 81,586

[22] Filed: Oct. 3, 1979

Related U.S. Application Data

[63] Continuation-in-part of Ser. No. 853,704, Nov. 21, 1977, abandoned.

[51] Int. Cl.[3] ..... B41J 33/20; B41J 33/24; B41J 29/26; B41J 35/28

[52] U.S. Cl. ..... 400/208; 400/213; 400/297.1; 400/696

[58] Field of Search ..... 400/208, 213, 213.1, 400/297.1, 696

[56] References Cited

U.S. PATENT DOCUMENTS

| | | | |
|---|---|---|---|
| 1,064,703 | 6/1913 | Brown | 400/213.1 |
| 1,087,990 | 2/1914 | Smith | 400/213.1 |
| 1,183,424 | 5/1916 | Baldwin | 400/696 |
| 2,803,331 | 8/1957 | Berill | 400/208 |
| 3,204,746 | 9/1965 | Wolowitz | 400/697.1 |
| 3,349,888 | 10/1967 | Page | 400/213.1 |
| 3,513,957 | 5/1970 | Ricciardi | 400/219.5 |
| 3,528,536 | 9/1970 | Caudill | 400/213.1 |
| 3,584,722 | 6/1971 | Albrile | 400/213.1 |
| 3,604,549 | 9/1971 | Caudill | 400/208 |
| 3,724,633 | 4/1973 | Korb | 400/208 |
| 3,731,781 | 5/1973 | Caudill | 400/214 |
| 3,782,521 | 1/1974 | Hengelhaupt | 400/213.1 |
| 3,871,507 | 3/1975 | Perry | 400/208 |
| 3,882,989 | 5/1975 | Morelli | 400/208 |
| 3,899,065 | 8/1975 | Brignole | 400/208 |
| 3,904,017 | 9/1975 | Frechette | 400/697.1 |
| 3,905,465 | 9/1975 | Frechette | 400/697.1 |
| 3,927,749 | 12/1975 | Wolowitz | 400/697.1 |
| 4,010,839 | 3/1977 | Guerrini | 400/227 |
| 4,022,313 | 5/1977 | Lau | 400/213.1 |

FOREIGN PATENT DOCUMENTS

| | | | |
|---|---|---|---|
| 935139 | 10/1973 | Canada | 400/208 |

*Primary Examiner*—Clyde I. Coughenour
*Attorney, Agent, or Firm*—Laurence R. Letson

[57] ABSTRACT

A ribbon and tape feed mechanism for a single element typewriter is disclosed. The ribbon feed mechanism and correction tape mechanism are mounted and configured to oscillate with the ribbon and correction tape cartridges when the cartridges and support therefore are tilted to present a portion of the ribbon or the correction tape to the print point of the typewriter for impact. The ribbon feeding and the tilt control of the cartridge is accomplished from a single cam having a plurality of sets of rises. The correction tape feed is driven from a second cam which is only engaged during those machine cycles when the machine is in a correction mode. The control of the correction mode is through the depression of the rear of the cartridge thus effecting the raising of the front portion of the cartridge and the correction tape to its operative position.

4 Claims, 13 Drawing Figures

RIBBON FEED MECHANISM AND CORRECTION TAPE FEED MECHANISM FOR A TYPEWRITER

This application is a continuation in part of application Ser. No. 853,704 filed Nov. 21, 1977, and now abandoned.

BACKGROUND OF THE INVENTION

Correction typewriters and mechanisms for feeding ribbons and correction tapes on typewriters have become relatively well known in the recent past. A primary example of such a typewriter is the IBM Correcting SELECTRIC typewriter which embodies a ribbon feed mechanism and ribbon cartridge substantially similar to that disclosed in U.S. Pat. No. 3,604,549 and U.S. Pat. No. 3,731,781. The correction tape feed is similar to that disclosed in U.S. Pat. No. 3,724,633.

With the increased use of cartridges, due to their ease of inserting and threading the ribbon and the cleanliness associated with handling a plastic cartridge as opposed to handling a printing ribbon and adhesive tape, it has become desirable to implement a system whereby the printing ribbon and the correction tape are both contained within cartridges. An example of a ribbon feed and cartridge design for accomplishing this in at least one environment is contained in my co-pending application Ser. No. 801,286, filed May 27, 1977 and commonly assigned with this application.

U.S. Pat. No. 4,010,839 discloses a periphery driven moveable axis take-up spool in a ribbon cartridge for a typewriter. U.S. Pat. Nos. 3,604,549 and 3,731,781, referred to above also disclose a ribbon spool on a fixed axis which is peripherially driven by spiked driver. The apparatus necessary to insert the spiked driver into the cartridge to accomplish such a driving function is relatively complex as can be seen from U.S. Pat. No. 3,604,549, referred to above.

Disadvantages of the prior art, involving fixed location or fixed axis take-up spools, are further compounded when the driving mechanism required to transport the ribbon and wind it on the take-up spool must also accommodate a superimposed cartridge containing a correction tape.

It is desirable to drive the respective take-up spools of the ribbon and correction tape around fixed axes to minimize the manufacturing cost of the consumable cartridge while at the same time accommodating the requirement for uniform tape increment feed and uniform ribbon feed, characteristics dictated by the nature of the ribbon and correction tape.

OBJECTS OF THE INVENTION

It is an object of the invention to feed ribbon and correction tape contained in and extending outwardly from enclosed superimposed cartridges, in uniform increments.

It is a further object of this invention to drivingly engage the ribbon take-up spool and/or ribbon disc and tape take-up spool and/or tape disc within their respective cartridges by peripherial drive members inserted into the cartridges.

It is an additional object of this invention to feed the printing ribbon a fraction of one complete increment on a first cycle and the remainder of the complete increment on the second cycle while using the driving cam element to control the elevation of the printing ribbon to two separate and discreet levels on succeeding cycles in proximity to the print line for impact by a printing element.

It is still another object of this invention to engage a cam member with a follower to accomplish the correction tape feed as a result of the depression of the rear of the ribbon cartridge.

The foregoing and other objects, features and advantages of the invention will be apparent from the following more particular description of a preferred embodiment of the invention, as illustrated in the accompanying drawings.

Figure 3:
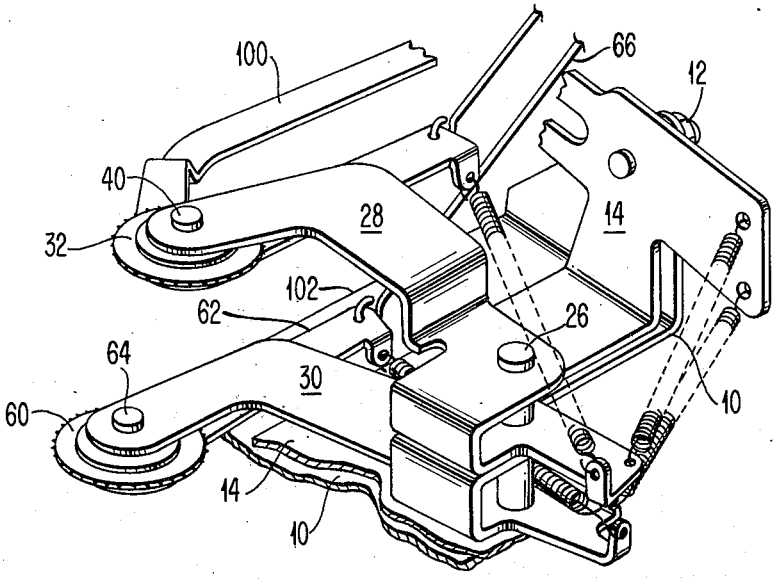
Figure 4A:
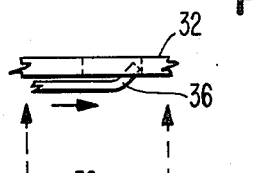

FIGS. 3, 4*a* and *b*, 5, 6 and 7 are partial views of the ribbon/tape feed mechanism.

Figure 8:
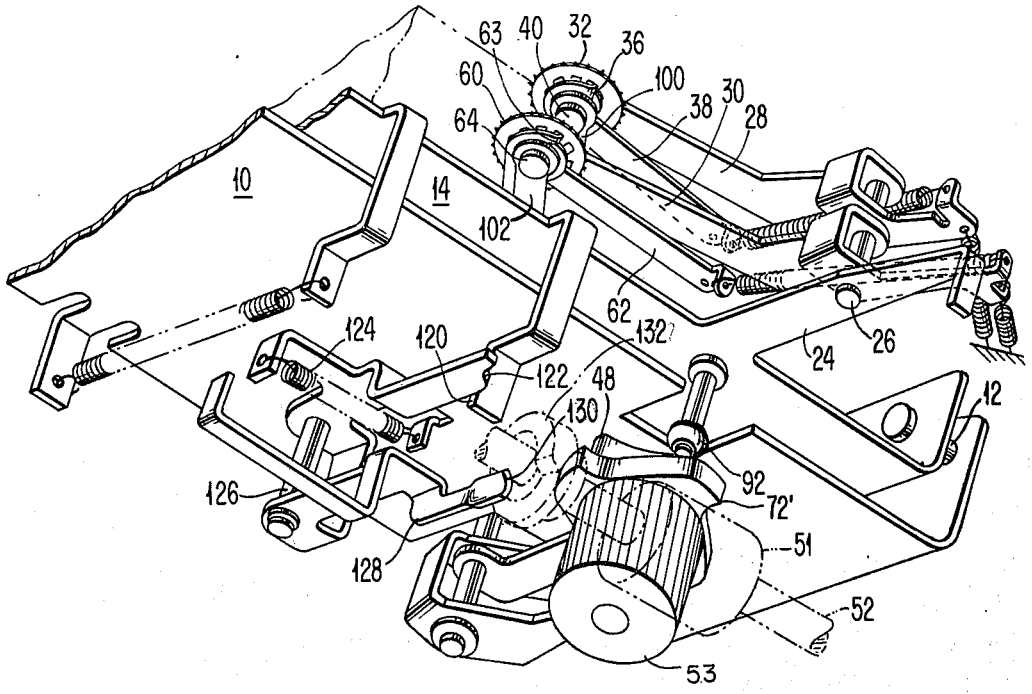

FIG. 8 is a perspective view of the underside of the ribbon/tape feed drive and latching arrangement.

Figure 9:
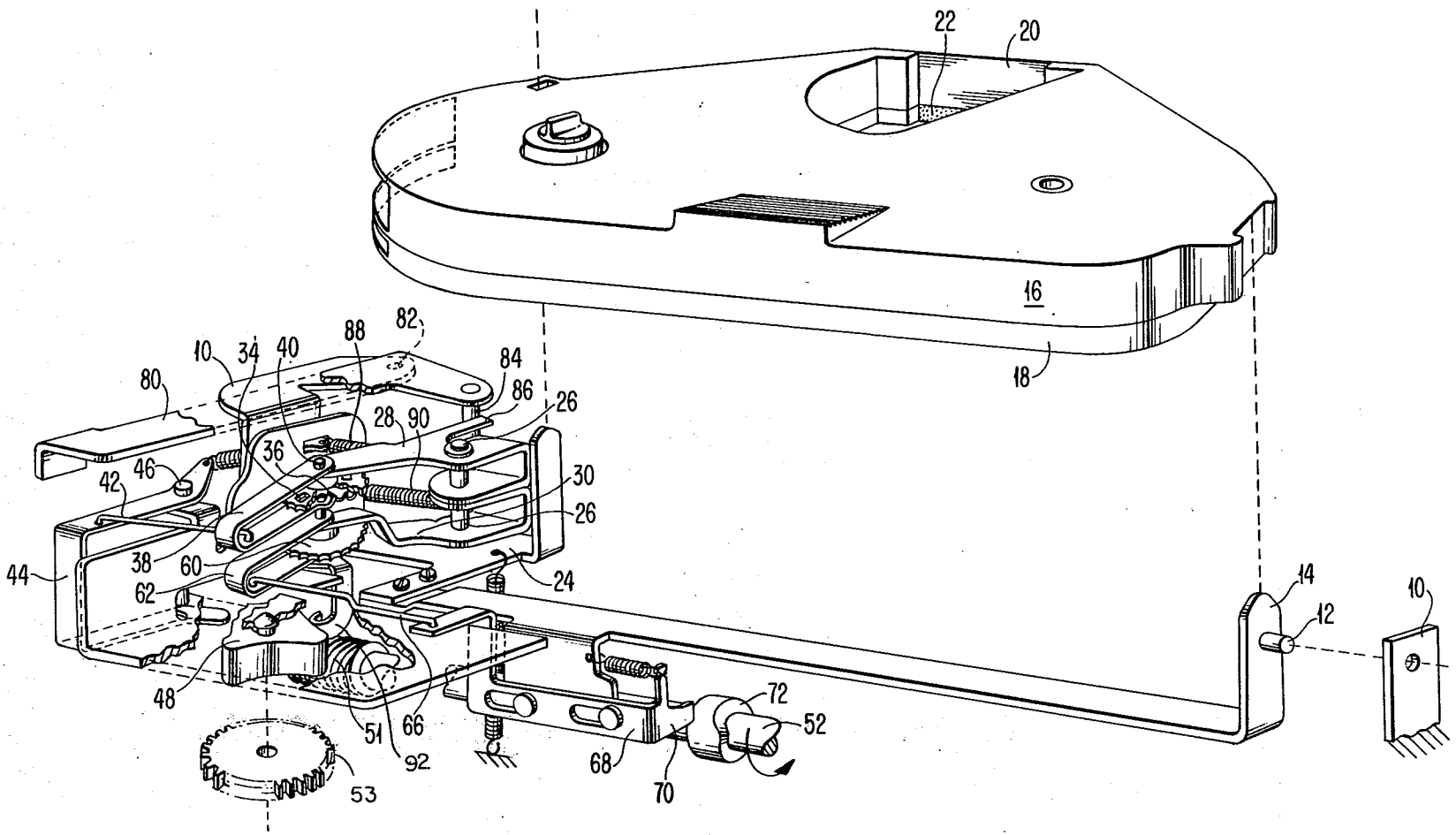

FIG. 9 is a perspective view of a second embodiment of the ribbon/tape drive.

Figure 10:
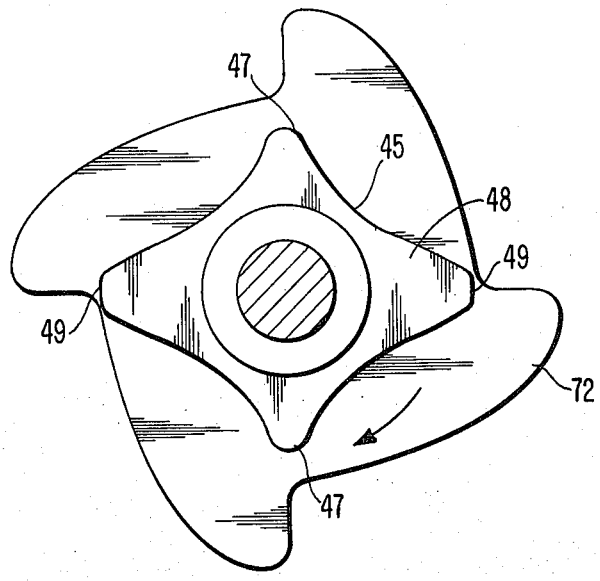

FIG. 10 is a plan view of the top of the composite cam having a feed/lift cam and a correction tape feed cam combined.

Figure 11:
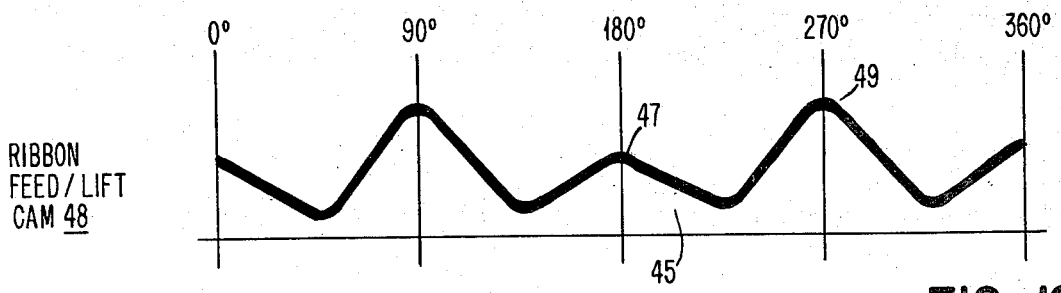
Figure 12:
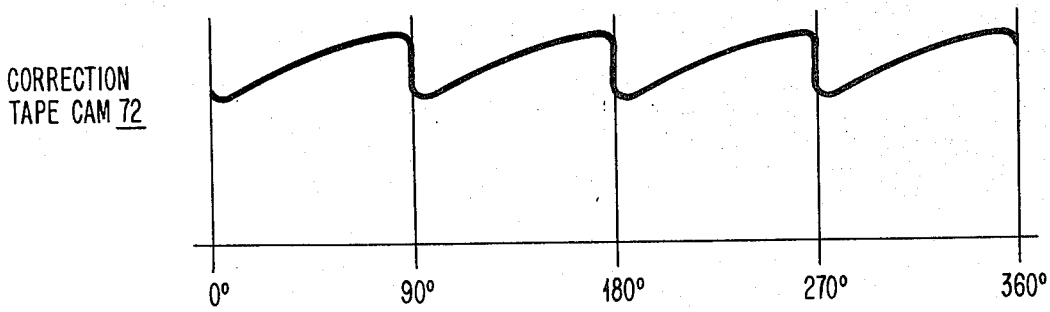

FIGS. 11 and 12 are cam rise diagrams for the cams illustrated in FIG. 10.

BRIEF SUMMARY OF THE INVENTION

The ribbon feed mechanism is mounted to pivot on the frame of the typewriter and to support the ribbon and correction tape cartridges thereon. The cartridges are fabricated to have an end opening in proximity to the take-up spool thereby permitting spring biased arms to enter into the cartridge and engage drive wheels with periphery of the take-up spool and ribbon or tape discs. The drive wheels are ratchet driven in response to cam follower movement. The rise of the lobes on the cam control the amount of movement or displacement of the cam follower and hence the ratchet drive thereby controlling the increment of feed. The same rises on the cam are utilized to control the rocking of the ribbon cartridge support to effect raising the ribbon to the print line and holding it in one of two different positions for printing. A normally disengaged cam follower and linkage is connected to the correction tape feed and mounted so that the follower will engage the correction tape feed cam upon the rocking of the cartridge support to its extreme displaced position thereby effecting the maximum rise of the tape cartridge and correction tape cartridge portions which span the type element to present the respective ribbon and tape to the print point. The ratchet feed utilized for the feeding of the ribbon is constrained so that the ratchet remains in position when the driving pawl is withdrawn and then allows the driving pawl to re-engage the ratchet drive surface to complete the drive for a complete feed increment upon the complete or full throw of the cam follower and connecting linkage.

The invention will be better understood by a thorough reading of the detailed description along with consideration of the drawings.

DETAILED DESCRIPTION OF THE INVENTION

During the course of this description, two embodiments will be described. In many respects the parts are either identical or functionally identical; in which case the same reference numeral will be used. Where there is a significant difference in either the construction or the mode of operation separate reference numerals or numerals printed will be assigned but will be fully described.

The ribbon feed as disclosed herein is contemplated for use on a typewriter having a moving paper carriage and a fixed print carrier. With only relatively minor modifications, the ribbon feed could be adapted to a moving print carrier. The frame 10 of the typewriter is configured to receive mounting and pivot pin 12 on the end of cartridge holder 14. Cartridge holder 14 is configured to accommodate cartridge 16 and 18. Cartridge 16 receives and contains the print ribbon 20 while cartridge 18 contains the correction tape. The two cartridges 16 and 18 both are configured to provide a supported entrance and exit from the major cartridge cavities such as to span a length of ribbon 20 and tape 22 respectively above and below each other. The span of ribbon 20 and tape 22 are such that they are spacially positioned between the printhead 9 of the typewriter and the platen 11. Cartridge holder 14 is also configured to provide other mounting surfaces upon which to support the other components of the ribbon drive and ribbon feed mechanism.

Holder extension 24 is either formed as a portion of the cartridge holder 14 or is attached rigidly thereto as is most convenient for the desired manufacturing technique, and provides a mount for pivot rod 26. Pivotally supported on pivot rod 26 are two independently swingable arms 28 and 30. Arm 28 carries on its end the ratchet feed mechanism for feeding the ribbon contained within the cartridge 16. The ratchet assembly to provide unidirectional feed has a feed wheel 32 with apertures 34 formed in the face thereof for engagement by a pawl member 36. The pawl member 36 is formed by deflecting a small tab on the lever 38. Lever 38 is coaxially mounted by one of its ends on the same axis pin 40 as supports the feed wheel 32.

To provide an input movement to the lever 38 push-pull link 42 is connected thereto and is connected on the opposite end thereof to cam follower 44 which is pivotally mounted on the follower pivot 46 for oscillatory movement. The cam follower 44 is supported on the frame 10 of the typewriter 8 as is the feed/lift cam 48. The feed/lift cam 48 is rotatably mounted on the frame member 10 to turn in response to the drive forces exerted thereon by gear pair 50 which includes a gear 53 mounted on the cam shaft and a gear 51 mounted on the operational shaft 52 of the typewriter.

Figure 1:
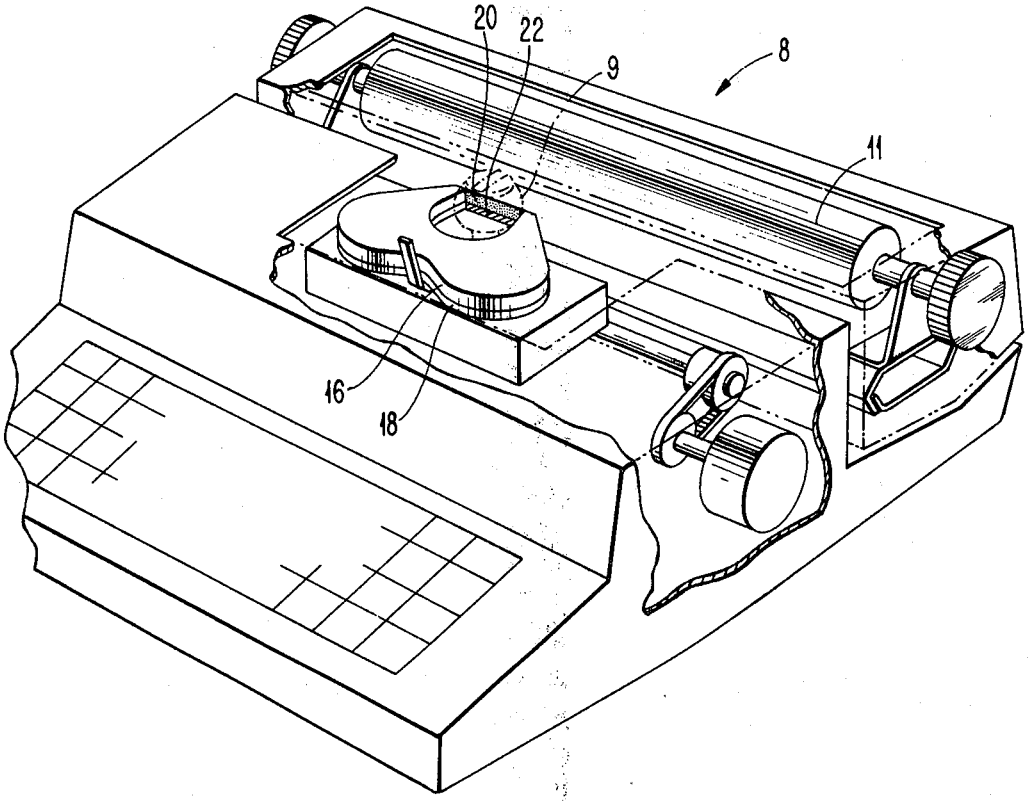
FIG. 1 illustrates a typewriter having a fixed print mechanism and ribbon feed and a moveable paper carriage.
Figure 2:
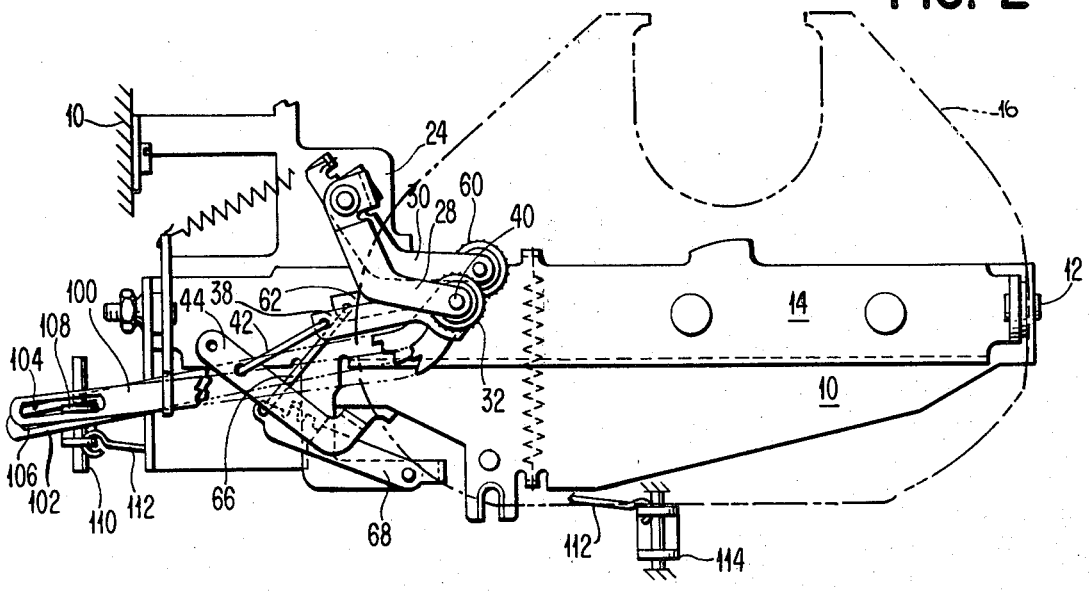
FIG. 2 is a plan view of a ribbon feed/tape feed mechanism capable of feeding ribbon and correction tape in cartridges.

A feed wheel and ratchet arrangement for arm 30, FIGS. 2 and 3, has substantially identical structure and function as that carried by arm 28 for the purpose of feeding the correction tape within the correction tape chamber of the cartridge. To provide motive force to the tape feed wheel 60 on arm 30, a feed arm 62 having formed into the end of it a pawl 63 is mounted upon an axis pin 64 as seen in FIG. 8. To provide an oscillatory or reciprocal input to the feed arm 62, feed arm 62 is connected to one end of a push-pull link 66 which is attached on its other end to a cam follower 68. In FIG. 9, cam follower 68 is slidably mounted to shift along an axis substantially parallel to the operational shaft 52 and to move with holder 14 as it moves to present different segments of ribbon and/or correction tape to the print point.

In view of the fact that follower 68 is mounted on holder 14 it is moveable about the axis of rotation of the holder 14 and tab 70 of follower 68 is thus capable of being displaced by the rocking of holder 14 to a region of engagement with correction tape feed cam 72. In FIG. 9, the correction tape feed cam 72 is illustrated as a face cam 72, mounted coaxially on the operational shaft 52 and rotated thereby. In the other figures where shown, the correction tape feed cam 72 which is coaxially mounted and rotates with the feed/lift cam 48 is engaged by tab 70' of cam follower 68 which is pivotally mounted upon holer 14 to thus be engaged with the cam profile only when the rear of the cartridges 16, 18 is depressed sufficiently to rotate the holder 14 about its axis to present the correction tape 22 to the print point. Upon the engagement of correction tape cam follower 68 with the feed cam 72, the follower 68 will oscillate and provide oscillatory motion to the feed arm 62 for rotation of the correction tape feed wheel 60 upon each rotation of the operational shaft 52 so long as holder 14 is held in the position corresponding to the correction tape being presented to the print point. With the correction tape feed cam 72 engaged by the correction tape feed follower 68, any otherwise normal printing operation will result in the impacting of the printhead 9 of the typewriter 8 onto the correction tape 22 and forcing it against the page at the print point. Inasmuch as the operational shaft 52 will rotate, as with any other printing operation, the tab 70 on the correction tape follower 68 engaged by the cam surface of cam 72, is caused to translate or oscillate, effecting the feeding of the correction tape within the correction tape cartridge 18.

In FIG. 9, a load lever 80 is illustrated as pivotally supported on the frame 10 at pivot point 82. On one end of load lever 80, is located an appendage 84. To retract the ribbon feed wheel 32 and arm 28 together with the tape feed wheel 60 carried on arm 30 from the interior of the ribbon and tape cartridges respectively, load lever 80 may be rotated around its pivot point 82 in a counterclockwise direction thus engaging projection 86 with appendage 84 on arm 28 and a corresponding projection on arm 30. Projection 86 and its counterpart on arm 30 will then be forced in a clockwise direction around their pivot rod 26 effectively retracting the ribbon feed wheel 32 and tape feed wheel 60 from the inside of cartridges 16 and 18. To release arms 28 and 30 for re-entry into the cartridges inner chambers, the load lever 80 may then be moved in a clockwise direction relieving the forces against projection 86 and its counterpart. When relieved, bias spring 88 and 90 will urge arms 28 and 30 respectively in a counterclockwise direction to present the feed wheels 32 and 60 to the periphery of the ribbon and correction tape take-up spools.

A comparable action to the mechanism in FIG. 9 is accomplished by the mechanism illustrated in FIG. 2, wherein pull links 100 and 102 are attached by means of axis pins 40 and 64 to the ribbon and tape feed ratchets 32, 60 and arms 28, 30 respectively. The pull links 100, 102 are provided with apertures 104 and 106, both of which are simultaneously engaged by bellcrank arm 108. Bellcrank arm 108 is rotated about horizontal axis 110 and controlled by link 112. Link 112 is attached to control lever 114 which may conveniently positioned to extend outward from the exterior of the typewriter.

Cartridge holder 14 is controlled during operation by the typewriter to present the ribbon at two different levels relative to the print point. The control of the level is accomplished through cam follower 92 engaging feed/lift cam 48. Referring to FIG. 10, the configuration of feed/lift cam 48 is illustrated with four lobes, two of a high rise 49 and two of an intermediate rise 47. The rises on the cam may preferably be designed such that the rise from low dwell 45 to high dwell of the largest lobe 49 is approximately equal to twice the net rise from low dwell 45 to the high dwell of the smaller intermediate lobes 47. This will cause the holder 14, through cam follower 92 to be rotated twice as much on the high dwell lobe 49 as for the low dwell lobe 47 thus moving the ribbon twice as far along its arcuate path. Should it be desired that some other relationship be maintained so that the ribbon is more fully recessed during non-printing, the low dwell 45 of the cam 48 may be reduced even more so. The actual dimensioning of the rises of the cam 48 is, of course, determined by the dimensional requirements of the particular ribbon feed into which it is incorporated.

Figure 6:
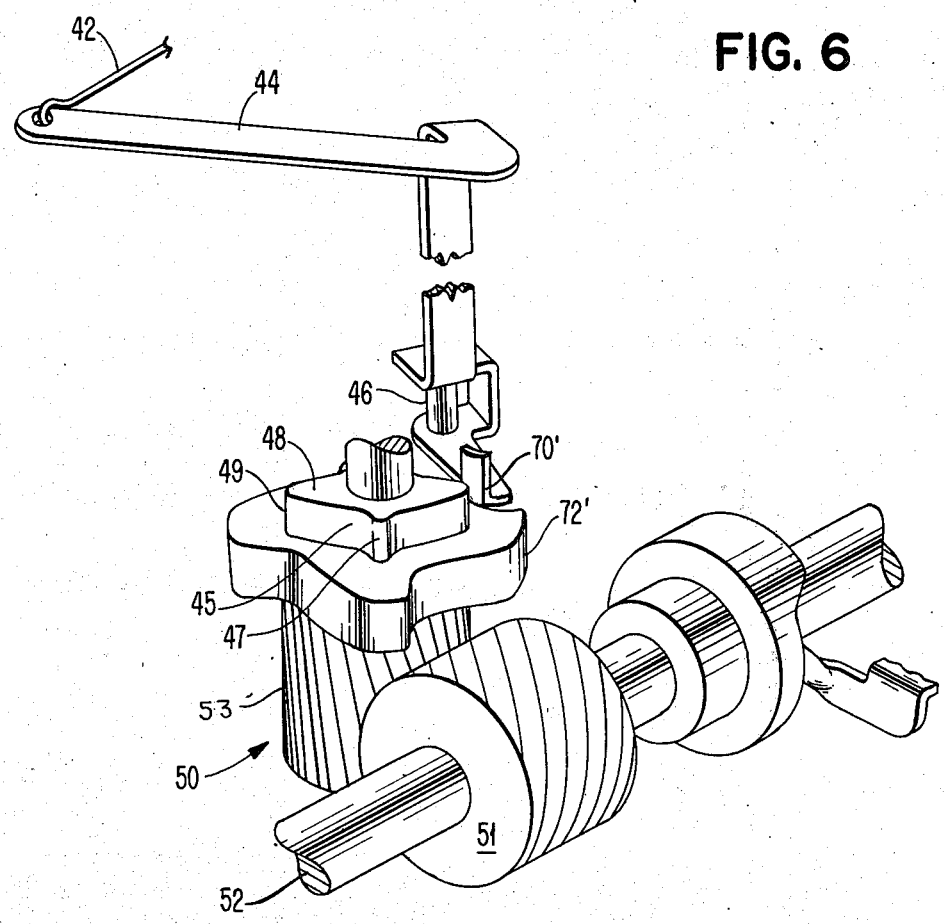

The other significant relationship with respect to the dwells of the cam 48 is that cam follower 44, FIG. 6, push pull link 42, lever 38 and feed wheel 32 are all dimensioned such that the rise of the cam 48 from its lowest dwell 45 to the highest rise 49 results in one complete ribbon feed increment. The relationship between the lowest dwell 45 and the rise on lobe 47 is not that critical, since the smaller rise will provide a partial increment of feed and due to the engagement of the pawl 36 on lever 38 with the apertures 34 in feed wheel 32. As seen in FIG. 4*a* and *b* the partial increment of feed will be accomplished during the low rise with the pawl 36 re-engaging the same aperture 34 on the next successive high rise 49 and not initiating feed until such time as the rise of the cam 49 has reached the equivalent of the preceeding low rise 47. At that point, the lever 38 will then have been displaced sufficiently far to engage the pawl 36 with the leading edge of apertures 34 and again feed the feed wheel 32 the remainder of the feed increment.

FIG. 11, illustrates a typical cam rise pattern for the lift/feed cam 48. FIG. 12 illustrates the typical cam rise pattern for the correction tape feed cam 72.

OPERATION OF THE INVENTION

Figure 4B:
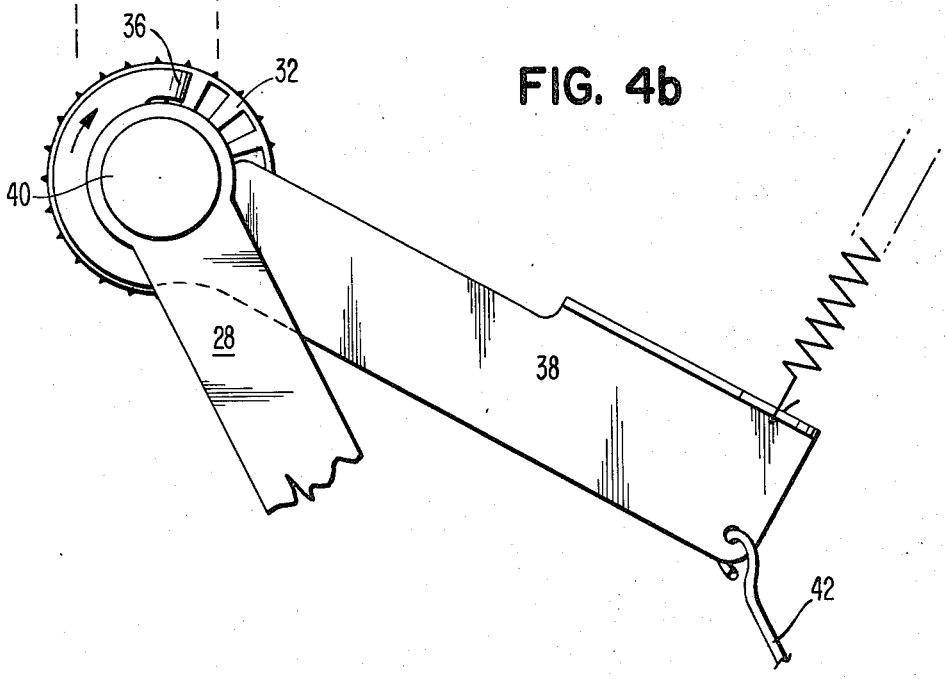
Figure 5:
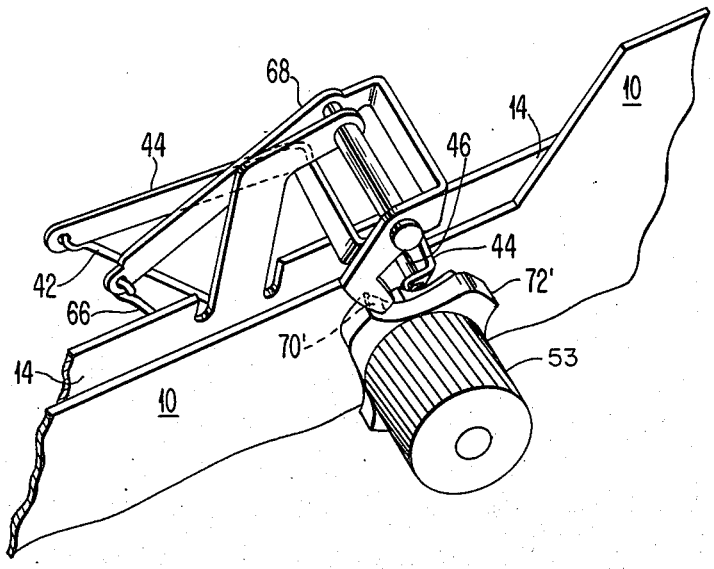
Figure 7:
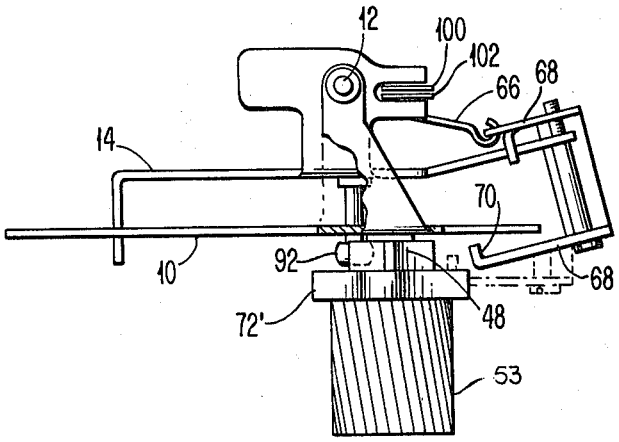

To insert the cartridges 16 and 18 into the ribbon feed mechanism, the pull lever 114 in FIG. 2, or the load lever 80 in FIG. 9, are pivoted about their respective axis to retract arm 28 and arm 30. The cartridges 16, 18 are then placed into the holder 14 in their appropriate position. After the placement of the cartridges 16, 18, the control lever 114 or load lever 80 are then returned to their disengaged position thus allowing arms 28 and 30 to enter the apertures formed in the end of the cartridges 16 and 18 and allow the feed wheel on each of the arms 28 and 30 to engage the periphery of the take-up spool or ribbon disc or tape disc, if ribbon or tape is already partially wound upon their respective spools. At this point the loading sequence is completed and the typewriter 8 is otherwise ready for operation. As each letter is typed, the operational shaft 52 is rotated one complete revolution by a drive mechanism which cyclically operates this shaft. As the shaft operates one revolution per cycle, gear pair 50, comprising gear 53 and 51 are respectively rotated about their axis. As gear 51 is rotated, it turns the superimposed feed/lift cam 48 and correction tape feed cam 72 in FIGS. 7 and 8 or only the feed/lift cam 48 in FIG. 9 a quarter revolution. The ribbon feed cam follower 44 is then oscillated by a single rise and fall of cam 48 and acts through push/pull link 42 to move lever 38 about the axis pin 40 and engage pawl 36 with the apertures 34 in feed wheel 32 thus causing feed wheel 32 to rotate a partial increment as best can be observed in FIGS. 4 and 8. On the next succeeding character the next cam lobe of feed/lift cam 48 is presented to the cam follower 44 and the sequence of operation repeated with only a variance in the amount of arc through which lever 38 is moved for each cycle of shaft 52 and quarter revolution of gear 53. Thus on every other cycle, the feed wheel is incremented through a completed ribbon feed increment.

To condition the typewriter 8 and particularly the ribbon feed mechanism to the correction mode, the rear of the cartridge 18 is depressed manually to cause the cartridges 16 and 18 and holder 14 to rotate about the axis of rotation of holder 14. The cartridges 16, 18 may be held in this displaced position or may be latched in the displaced position by a latch 120, 122. As holder 14 is tilted or partially rotated about its axis, the correction tape feed cam 72 is engaged by the tab 70 on the follower 68. As the machine then operates in the next print cycle, the push/pull link 66 is translated along with follower 68 to effect movement of the feed arm 62 about its axis pin 64 and thereby rotate tape feed wheel 60 a partial revolution corresponding to a complete correction tape feed increment. If holder 14 is latched in its displaced position, thus presenting the correction tape to the print point after the typehead has impacted the correction tape against the printed page, the latch may be unlatched by any cyclically operated apparatus in the typewriter which is conveniently placed nearby. As an example, FIG. 8 illustrates a latch surface 120 depending from holder 14. Engageable with the latch surface 120 is latch member 122 which is spring biased by spring 124 about pivot 126, attached to frame 10. Latch member 122 is provided with cam follower arm 128 which terminates in cam follower surface 130. Surface 130 will pivot clockwise to engage a face cam surface 132 on operational shaft 52, when holder 14 is pivoted and moves latch surface 120 forward. The movement of surface 120 permits latch member 122 to pivot behind latch surface 120 and hold it in its displaced position until the use of face cam 132 causes counterclockwise movement of latch member 122, thereby unlatching surface 120 and holder 14 for restoration. As the latch 120 is released, holder 14 will then return to its normal, at rest position, prepared to be elevated in the next machine cycle to its position corresponding to a printing position.

After the correction tape 22 or the ribbon 20 are exhausted from their respective cartridges 18 and 16, the cartridge of the exhausted supply is removed and replaced with a new cartridge. The removal procedure is substantially that described earlier with respect to the installation, of retracting the arms 28, 30 carrying the feed wheels 32, 60 while the cartridges 16, 18 are lifted from the holder 14.

This ribbon feed mechanism together with its operation provides the substantive advantages of being able to use a cartridge which has a fixed axis take-up spool together with a direct peripheral drive for uniform feed increments.

While the invention has been particularly shown and described with reference to two embodiments thereof, it will be understood by those skilled in the art that the foregoing and other changes in form and details may be made therein without departing from the spirit and scope of the invention.

I claim:

1. A ribbon feed mechanism, in combination with a single element impact printer having a print line and having a cyclically operable shaft, said printer being cyclically operable in print and correction modes, said mechanism capable of accepting a cartridge containing a printing ribbon and a correction tape, said combination operative to feed said printing ribbon and correction tape in said cartridge, said cartridge comprising superimposed supply spools; and superimposed take up spools having spatially fixed axes with respect to said cartridge, said take up spools respectively for receiving used ribbon and supporting a ribbon disc and for receiving used tape and supporting a tape disc, said ribbon feed mechanism comprising:

a holder for said cartridge mounted on said typewriter for cyclically controlled oscillation of said holder and said cartridge to move said ribbon in a direction substantially perpendicular to said print line;

a ribbon drive wheel insertable into said cartridge and peripherally engageable with said ribbon disc for rotating said ribbon disc to feed said ribbon in feed increments;

a tape drive wheel insertable into said cartridge and peripherally engageable with said tape disc for rotating said tape disc to feed said tape;

a first cam means mounted for intermittent rotation and driven by said shaft;

a first cam follower means interconnecting said first cam means and said ribbon drive wheel for effecting ribbon feed in said feed increments upon the rotation of said cam means;

a second cam follower means interconnecting said first cam means and said holder to effect said oscillation of said holder and said cartridge to present a plurality of levels of said ribbon at a writing line of said printer and to permit depression of said cartridge to a position whereby the ribbon is below the writing line;

a second cam means mounted for intermittent rotation and driven by said shaft;

a third cam follower means operatively connected to said tape drive wheel, and mounted for normal disengagement from said second cam means when in said print mode, and oscillatable into engagement with said second cam means by the elevation of said cartridge to effect feed of said correction tape when in said correction mode, whereby said ribbon is fed upon each cyclic operation of said shaft and tape is fed upon each cyclic operation of said shaft when said second cam is engaged by said third cam follower means by said drive wheels onto a fixed axis takeup spool within said oscillatable cartridge.

2. The ribbon feed mechanism of claim 1 wherein said first cam means comprises a plurality of lobes of varying rise, the rise of the highest lobe corresponding to a complete feed increment in excess of the widest character printed by said printer, and lobes of a lower rise corresponding to a fraction of said feed increment.

3. The ribbon feed mechanism of claim 1 wherein said ribbon drive means and said tape drive means are mounted on separately pivotally mounted arms for engagement with and retraction from said take up spools.

4. The ribbon feed mechanism of claim 3 wherein said arms are mounted on said holder to oscillate therewith to provide relatively fixed feed wheel engagement with said take up spools, during oscillation of said holder.

* * * * *